US005170646A

United States Patent [19]

Gariboldi

[11] Patent Number: 5,170,646

[45] Date of Patent: Dec. 15, 1992

[54] METHOD FOR FORMING POCKET USING RECIPROCATING MOTION IN TUBULAR KNIT HOSIERY MANUFACTURING AND PRODUCT MADE THEREBY

[75] Inventor: Franco Gariboldi, Condove, Italy

[73] Assignee: Meritex S.r.l., Firenze, Italy

[21] Appl. No.: 682,599

[22] Filed: Apr. 8, 1991

[30] Foreign Application Priority Data

Apr. 27, 1990 [IT] Italy ..... 9375 A/90

[51] Int. Cl.[5] ..... D04B 1/26

[52] U.S. Cl. ..... 66/51; 66/172 R; 66/187

[58] Field of Search ..... 66/48, 51, 172 R, 173, 66/179, 186, 187

[56] References Cited

U.S. PATENT DOCUMENTS

| | | | |
|---|---|---|---|
| 3,650,126 | 3/1972 | Luchi | 66/48 |
| 3,785,173 | 1/1974 | Hanney et al. | 66/172 R X |
| 4,188,804 | 2/1980 | Hoffmann | 66/24 |
| 4,561,266 | 12/1985 | Häcker | 66/51 |
| 4,589,267 | 5/1986 | Barbee | 66/187 X |
| 4,644,762 | 2/1987 | Häcker | 66/51 |

FOREIGN PATENT DOCUMENTS

| | | | |
|---|---|---|---|
| 3503891 | 9/1985 | Fed. Rep. of Germany | 66/187 |
| 706344 | 5/1966 | Italy | 66/187 |
| 1069812 | 5/1967 | United Kingdom | 66/187 |

*Primary Examiner*—Werner H. Schroeder
*Assistant Examiner*—John J. Calvert
*Attorney, Agent, or Firm*—McGlew and Tuttle

[57] ABSTRACT

The tubular knit product with a pocket and a method for forming the pocket using reciprocating motion in tubular knit hosiery manufacturing. The method uses a circular knitting machine fed by a plurality of yarn feeds which all participate in the formation of the pocket by a reciprocating motion. During the reciprocating motion, part rows of stitches from yarns of the various feeds are formed in a sequence on a course. For the next preceding opposite course, the part rows of stitches from the yarns of the various feeds are formed in a sequence which is opposite. For each subsequent course, the sequence is opposite to the preceding course, and the course direction is opposite (reversed). On each successive reversed course, the yarns of the various feeds form rows which progressively decrease in a first part of the construction of the pocket and progressively increase in a second part of the construction of the pocket. The points of reversal of the rows formed by the various yarns on one side of the pocket appear in a sequence-opposite to that in which they appear on an opposite side of the pocket.

14 Claims, 5 Drawing Sheets

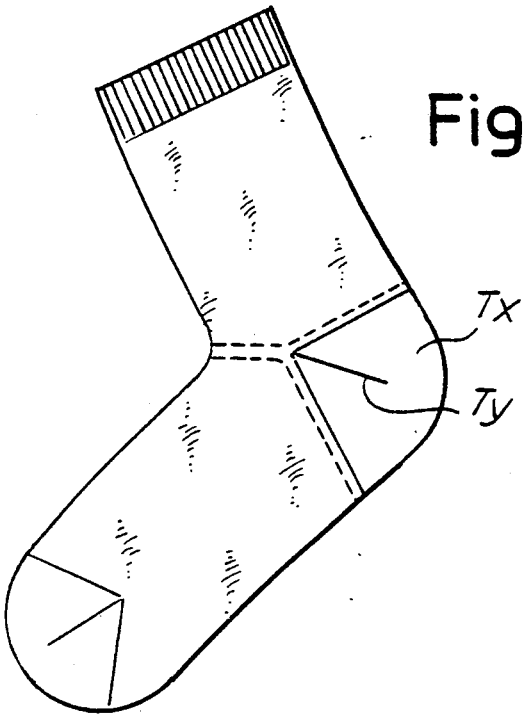
Fig. 5
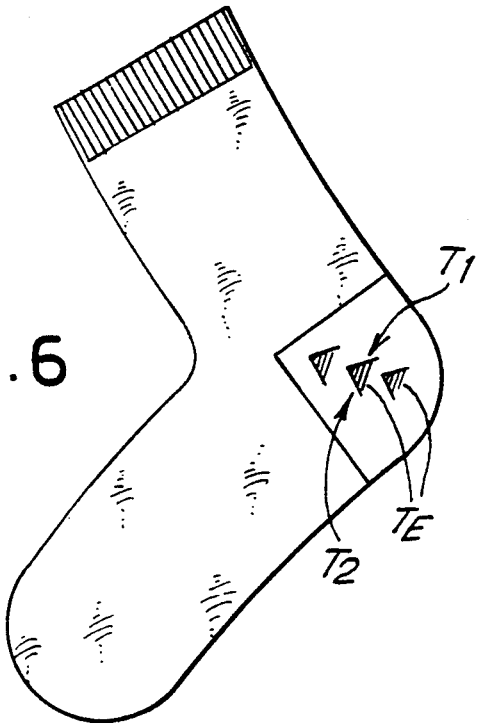
Fig. 6
Fig. 7
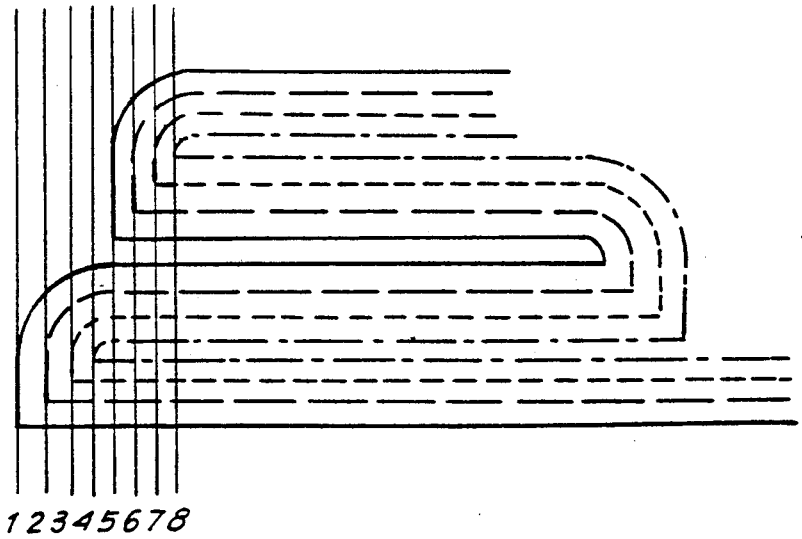

METHOD FOR FORMING POCKET USING RECIPROCATING MOTION IN TUBULAR KNIT HOSIERY MANUFACTURING AND PRODUCT MADE THEREBY

FIELD AND BACKGROUND OF THE INVENTION

In the LUCHI patents of 1967/68 (Italy no. 818,060, West Germany no. 1,815,936, U.S. Pat. No. 3,650,126) and in the subsequent HOFFMAN patents of 1977/78 (Italy no. 1,078,922, West Germany no. 2825864.2, U.S. Pat. No. 4,188,804), a method has been described for the formation of a pocket in a tubular manufactured article (such as a heel for a woman's stocking or man's sock or in general, and/or the toe of such a manufactured article or other). Production is by means of at least two yarn feeds, with reciprocating motion of the needle cylinder, with such an arrangement that a group of rows of stitches according to a given sequence of yarns is followed by a group of rows of stitches according to a reversed sequence of these yarns. Each feed supplies the yarn to needles of an arc which is staggered in relation to the arc which has been supplied with yarn from another feed. The arcs are superposed partially in an intermediate zone of greater development of the pocket. The rows of stitches formed during the formation of the pocket are comprised in the arc of needles defined by the two rows of stitches which are most staggered in relation to one another. A number of arcs of needles are all partially staggered in relation to one another in the same direction and are obtained with yarns fed from the same number of staggered feeds. Moreover, the angular development of the pocket is varied by variation of the stitches at the external ends of the rows of stitches which are most staggered in relation to one another.

SUMMARY OF THE INVENTION

The present invention relates to a method as mentioned above and consequently to a pocket (heel or other) obtained using this method, as an improvement of the Hoffmann patent which is available to the applicant. Aims and advantages of the present invention will be clear from a reading of the following text.

Essentially, this method for the formation of a pocket of a manufactured article—such as a heel of a stocking or sock—envisages the use of a circular knitting machine which is capable of operation by means of reciprocating motion and is fed by means of a plurality of yarn drops (feeds), which also participate in the formation of the pocket using reciprocating motion. The method envisages that on every course in one direction—during the reciprocating motion—the part rows of stitches from the yarns of the various drops are formed in a sequence opposite to that in which the part rows are formed during the preceding and following opposite courses. According to the invention, on each successive reversed course, the yarns of the various drops form rows which are all progressively decreased in the first part of the construction of the pocket and progressively increased in the second part of the construction of the pocket, the points of reversal of the rows formed by the various yarns on one side of the pocket appearing in a sequence opposite to that in which they appear on the opposite side of the pocket.

The present invention also relates to a tubular knitted manufactured article with a pocket—such as a heel in a stocking or sock—which is obtained using reciprocating motion of the cylinder of a circular knitting machine and using a number of yarn drops (feeds), in which pocket the part rows of a group which are formed by successive feeds and then the rows of a similar group of rows formed by the same feeds but in reversed order follow each other. According to the invention, all the part rows are developed from one side to the other of the pocket and are of progressively decreased extension in the first part of the structure of the pocket and of progressively increasing extension in the second part of the structure of the pocket.

BRIEF DESCRIPTION OF THE DRAWINGS

The invention will be understood more clearly by following the description and the attached drawing which shows a non-limiting exemplary embodiment of the invention itself and in which:

FIG. 5 is similar to FIG. 1, but shows an improvement in the formation of the heel;

FIG. 6 repeats the diagram in FIG. 1 in order to illustrate the manner of bringing about the improvement;

FIGS. 7 and 8 show a diagram similar to that in FIG. 3 and a diagram which is similar but modified according to the improvement in FIG. 5.

DETAILED DESCRIPTION OF THE PREFERRED EMBODIMENT

Figure 2:
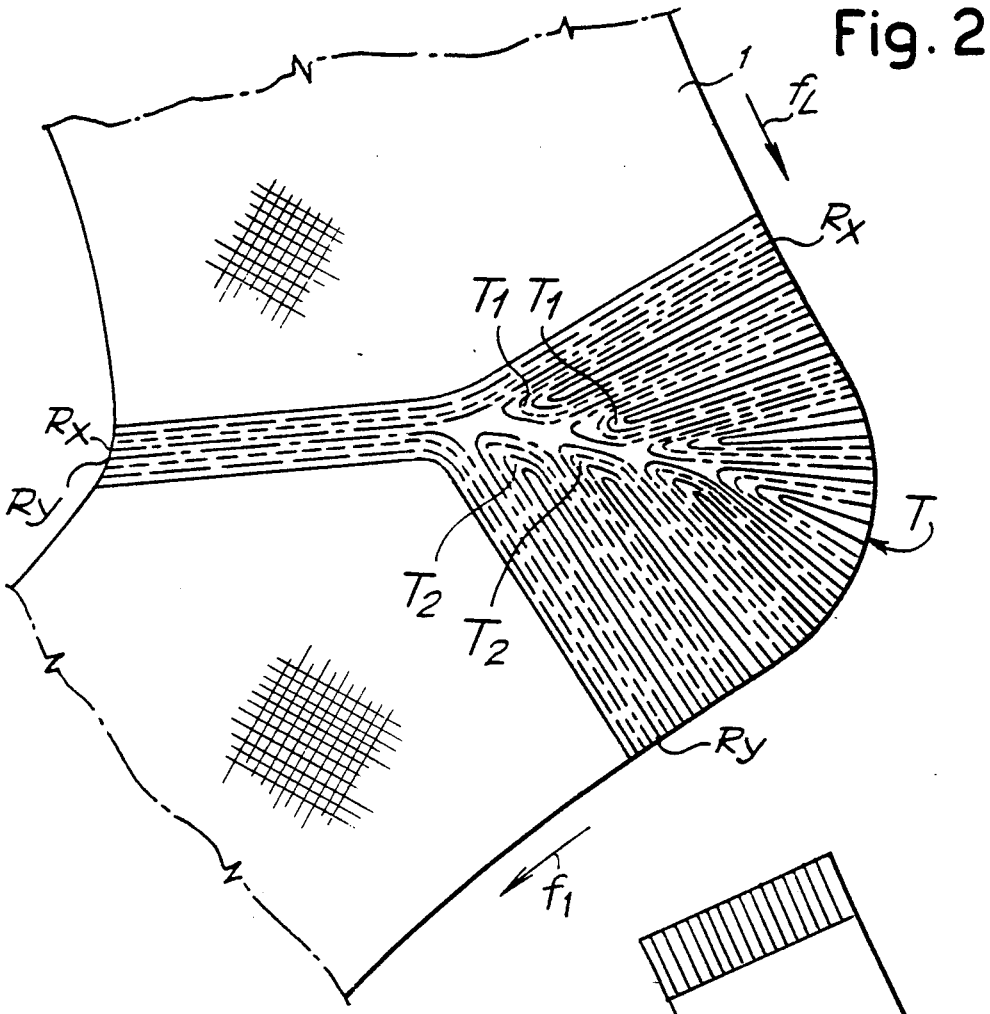
FIG. 2 shows the manufactured article with the heel and the complete rows and part rows for the formation of the heel.

According to what is illustrated in the attached drawing, after the formation of a first portion of manufactured article 101 by means of progressive formation of the rows according to the arrow fL of the knitting work carried out, on reaching the line 103 of the last continuous row, the formation of the heel T is started using reciprocating motion of the needle cylinder. The amplitude of the oscillation of the needle cylinder—for a normal stocking or sock-type manufactured article—extends for approximately one rotation and a half, that is to say for approximately 540°, envisaging an arrangement of feeds as shown in FIG. 4. FIG. 4 shows four feeds, that is to say drops A1, A2, A3, A4 which are distributed uniformly around the circumference of the work zone of the needles. In this needle work zone, the cylinder C diagrammatically illustrated in said FIG. 4, there is developed in a circular sector a given number of part rows of stitches in decreases and in increases respectively. In the diagram in FIG. 3, the part rows are shown in their development. After completion of the last row RX of the tubular section 101 of the manufactured article before the formation of the heel T, and before restarting the circular motion with the row RY for the formation of the successive section 105 of tubular manufactured article, the heel T is formed using reciprocating motion of the needle cylinder. Using four drops, that is to say using four yarn feeds F1, F2, F3, F4, there are formed on each rotation four continuous circular rows during the formation of the section 101 and of the section 105 of the manufactured article. During the formation of the heel T, the four yarn drops F1, F2, F3, F4 are held in the four feeds, that is to say drops A1, A2, A3, A4, as a result of which, on each oscillation of the needle cylinder, four part rows are formed. The lengths of these part rows are variable in the manner indicated below and in particular visible in FIGS. 3 and 4. In the formation of the heel, during the first part of such formation, the part rows are reduced, that is to say decreased in extension, as a result of which, on the inside of the heel, there come to be formed small inclined connection sections indicated by T1. These extend approximately until halfway through the development of the heel. Subsequently, in the zone of the augmentations, that is to say increases, there come to be formed similar and opposite connection lines, indicated by T2, which can be barely slightly staggered in relation to the lines T1. In FIG. 2, the courses of the part rows in the heel T are indicated in a rough manner, clearly with a very limited number of part rows even with regard to a structure made using very thick yarns.

Figure 3:
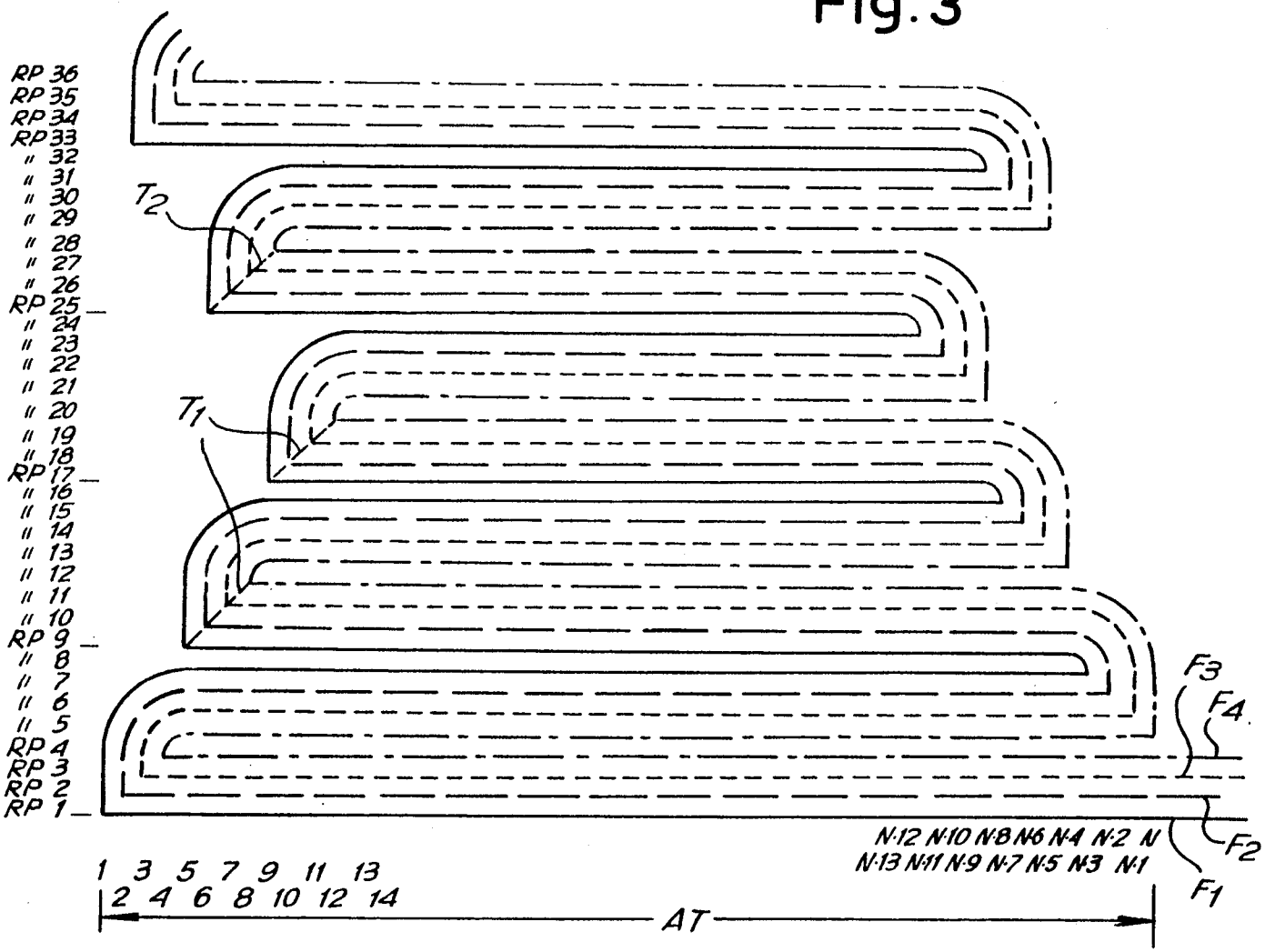
FIGS. 3 and 4 show diagrams to indicate the course of the part rows in a manufactured article produced using a circular machine with four drops, that is to say four feeds.
Figure 4:
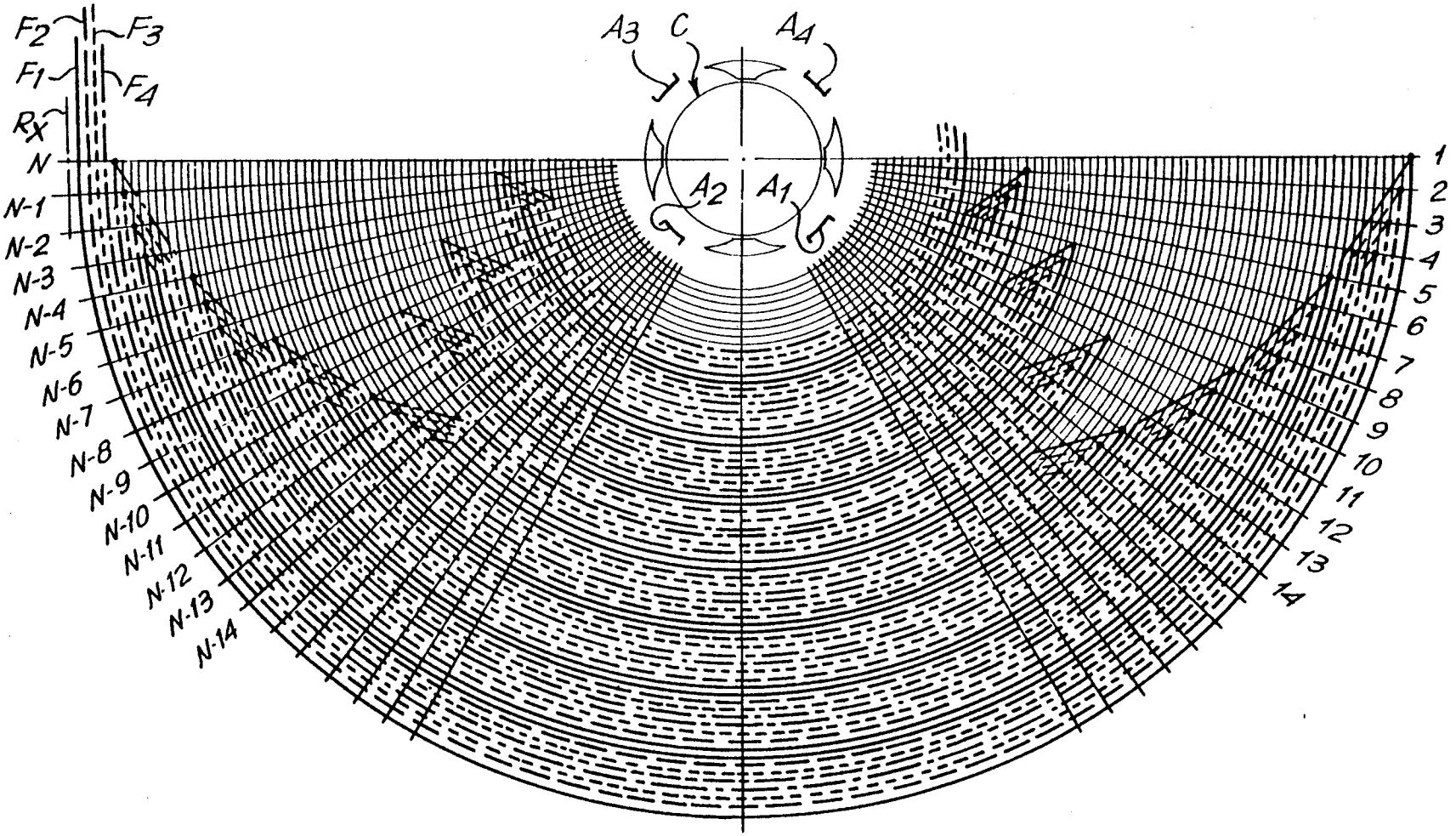

In FIGS. 3 and 4, and in particular in FIG. 3, a very simplified diagram is shown, which has a greatly reduced number of decreases and increases, in order to describe the structure of the heel and the method of constructing it. In FIG. 3, AT indicates the arc of needles for the formation of the fabric, and N needles are assumed as maximum limit of the extension of the part rows of stitches. The production of the heel is carried out using a single command of the needles in order to obtain the decreases, that is to say the reductions, and the augmentations, that is to say the increases, of the individual arcs of needles and thus of the individual part rows. This can be achieved very easily using the modern selection systems of the electronic type and advantageously with the exclusion of the needles by means of their release at a low level—especially just higher than that of the lower end of the knitting cam—and thus in a state of exclusion. Advantageously, means will also be provided for avoiding excessive stress on the stitches held engaged by the needles in the state of exclusion by lowering, in connection with the transit in front of each of the knitting cams, that is to say cams for the lowering of the needles during the formation of the heel.

By following in particular the diagram in FIG. 3, it is supposed that the arc AT of active needles for the formation of the heel consists of n needles, which can for example be half the number of needles of the cylinder. The part rows of stitches are indicated by RP1, RP2–RP35, RP36. Considering the first part row RP1, this is formed by the yarn F1 of the feed or drop A1 which forms stitches along the whole of the arc AT as far as needle number 1. The second yarn F2, which forms a row of stitches immediately after the yarn F1, forms stitches only as far as needle 2. The third yarn F3 forms stitches only as far as needle 3 and the fourth yarn F4 forms stitches only as far as needle 4. The movement of the needle cylinder being reversed, the first part row of stitches RP5 which follows the first four part rows RP1, RP2, RP3 and RP4 is formed by the same yarn F4 which formed the row RP4 and which now forms the row RP5 as far as needle N. The part row RP6, formed by the yarn F3 as far as needle N-1, follows; then the part row RP7 is formed as far as needle N-2 using the yarn F2, and then the part row RP8 using the yarn F1 as far as needle N-3; upon the new reversal of the motion of the needle cylinder, the first part row which is thus formed is the row RP9 using the yarn F1 as far as needle 5. Directly afterwards, the part row RP10 is formed using the yarn F2 as far as needle 6, and then the part row RP11 using the yarn F3 as far as needle 7 and finally the part row RP12 using the yarn F4 as far as needle 8. Upon the new reversal, the formation is then started of the part row RP13 using the yarn F4 as far as needle N-4. The part row RP14 follows, using the yarn F3 as far as needle N-5, then the part row RP15 is formed by the yarn F2 as far as needle N-6 and finally the part row RP16 is formed using the yarn F1 as far as needle N-7. Upon the new reversal, it is the yarn F1 which forms the part row RP17 as far as needle 9, after which the yarn F2 forms the part row RP18 as far as needle 10 and then the row RP19 is formed by the yarn F3 as far as needle 11 and the row RP20 is formed by the yarn F4 as far as needle 12. Again, upon the subsequent reversal, the part row RP21 is formed by the yarn F4 as far as needle N-8, and this is followed by the part row RP22 using the yarn F3 and as far as needle N-9 and then the part row RP23 using the yarn F2 as far as needle N-10 and the part row RP24 using the yarn F1 as far as needle N-11. At this point it is supposed, in the simplified diagram in FIG. 3, that the decreases, that is to say the reductions in extent of the part arcs, stop and the increase of these part arcs starts, so that the first part of the formation of the heel is completed and the second part of the formation of the heel by means of the increases is thus started. The first part row RP25, which starts the increase in extent of the part rows, is formed by the yarn F1 as far as needle 6. The formation follows of the part row RP26 using the yarn F2 as far as needle 7, then the formation of the row RP27 as far as needle 8 and the formation of the part row RP28 as far as needle 9. The last reversal of the needle cylinder brings about the formation of the part rows RP29, RP30, RP31, RP32 using the yarns F4, F3, F2, F1 respectively, which end respectively at needles N-5, N-6, N-7 and N-8. Upon the subsequent reversal of the motion of the needle cylinder, the formation is then started of the part row cylinder, the formation is then started of the part row RP33 using the yarn F1 as far as needle 2, then the formation of the part row RP34 using the yarn F2 as far as needle 3 and then the formation of the part row RP35 as far as needle 4 using the yarn F3 and the formation of the part row RP36 using the yarn F4 as far as needle 5. The formation of the second part continues using the same principle.

The structure of the fabric can be improved in the area of the increases and decreases if provision is made upon inversion of the knitting direction, that at least one needle for each row produces a held or float stitch.

It is clear from the description that the arrangement of the part rows affects the whole of the arc of needles AT for the formation of the heel using decreases, that is to say using reductions of the part rows of stitches, which affect all the yarns F1, F2, F3, F4 which were also involved in the formation of the section of manufactured article 101 and which will subsequently form the section of manufactured article 105, in contrast to previous and previously mentioned solutions which envisaged decreases and increases only for one or a maximum of two of the yarns which form part rows, while the part rows formed by the other feed yarns were of constant extent. The arrangement according to the invention makes it possible to obtain a pocket, that is to say a heel, which is better shaped and also more uniform and much more like the conventional heels formed using the reciprocating motion of the needle cylinder and using one single yarn feed.

Figure 1:
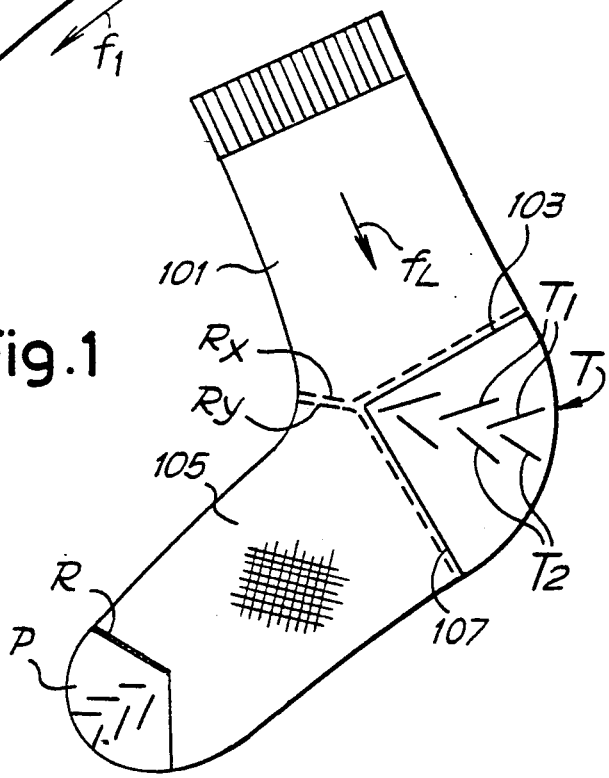
FIG. 1 shows diagrammatically a sock-type manufactured article with the heel formed according to the invention, in the internal view which shows up the structure of the connections of the part rows.

Returning to the diagram in FIG. 1, after the formation of the last complete row RX and that is to say at the front 103 reached by the production according to the arrow fL, the formation is started of the heel using the decreases which progressively give rise to the formation of the connection lines T1, essentially as far as halfway through the formation of the structure of the heel T, then to give rise to the formation of the second part of the heel using the increases in part rows of stitches which give rise to the connection lines T2 until the final front 107 of the heel is reached, after which the circular motion of the needle cylinder is restarted with the formation of the first continuous circular row RY and of the successive rows for the formation of the section 105 of the manufactured article which follows the heel or pocket T. After the formation of the section 105, which forms the foot of the stocking or sock, another pocket can be produced using reciprocating motion and similar to the heel T, which is capable of forming the shaped toe P; this pocket P is then closed at the final edge of the section 105 by means of a darn R formed by means of an auxiliary conventional machine.

From the above description, it emerges clearly that, in the zone of the decreases, the reduction in extent of the part rows is very progressive and gradual as, in the zone of the increases, the augmentation of the extent of the part rows is also very gradual.

In the diagrams in FIGS. 3 and 4, it is supposed that the reduction takes place at each needle, but the possibility is not excluded that the reduction can also take place, not at one needle at a time, but every two needles or every three needles or otherwise, according to the number of part rows with which it is envisaged to form the heel or pocket and to the design of the same heel or pocket.

From the preceding description, it is clear that during the formation of the second part of the heel, that is to say of the increases, there is a progressive connection of the ends of the increased part rows to the ends of the decreased part arcs in the first part of the formation of the heel. In order to avoid apparent irregularities in the connection, it is advantageous and it emerges from the preceding description that the connections of the ends of the part rows take place with a stagger which can be of one or more needles between the ends of the decreasing rows and those of the increasing rows; for example, the part row RP9 formed using the yarn F1 ends in the region of needle 5, while the corresponding part row RP25, still formed using the yarn F1, ends in the region of needle 6, as a result of which there is a stagger in the connection between ends of part rows of stitches. This gives rise to a slight stagger of the connection lines T1 and T2 and ultimately to a greater uniformity in the structure of the heel.

It is further clear that—as already stated—the part rows formed by all the yarns F1, F2, F3, F4 affect the arc AT of the needles intended for the formation of the part rows, and thus there is the greater uniformity already mentioned of the formation of the heel in relation to the formation of heels using the techniques recalled in the introduction.

On the basis of what has been described in the preceding case, there are obtained in the heel T the segments indicated by T1 and T2—due to the marking lines of the decreases and of the increases—which have an approximately herring-bone form. This esthetic motif can be improved by means of what is described below. It is thus possible to vary and to improve the appearance of the marking lines of the decreases and of the increases and in particular in order to render them similar to those produced using conventional machines, in which the working of the pockets of the heel and of the toe is carried out using a single feed; that is to say the formation is possible of a structure of the heel Tx like that indicated by Ty in FIG. 5, with a single line, approximately on the bisector of the angle formed on each side of the heel Tx.

Starting from the diagram in FIGS. 5 and 6, it is a matter of eliminating the hatched fabric zone TE comprised between the two marking lines, that of the decreases T1 and that of the increases T2, in such a manner that the two branches T1 and T2 are superposed, that is to say practically come to coincide.

In order to achieve this superposition, it is necessary that, after the reversal of the direction of knitting, the sections of row comprised between the needles in positions 1 to 4 and then 5 to 8 (see FIG. 7) and so on are formed by held or float loops, so as not, in any case, to produce an increase in area; consequently, the formation of fabric in the zone TE in FIG. 6 is eliminated.

Figure 8:
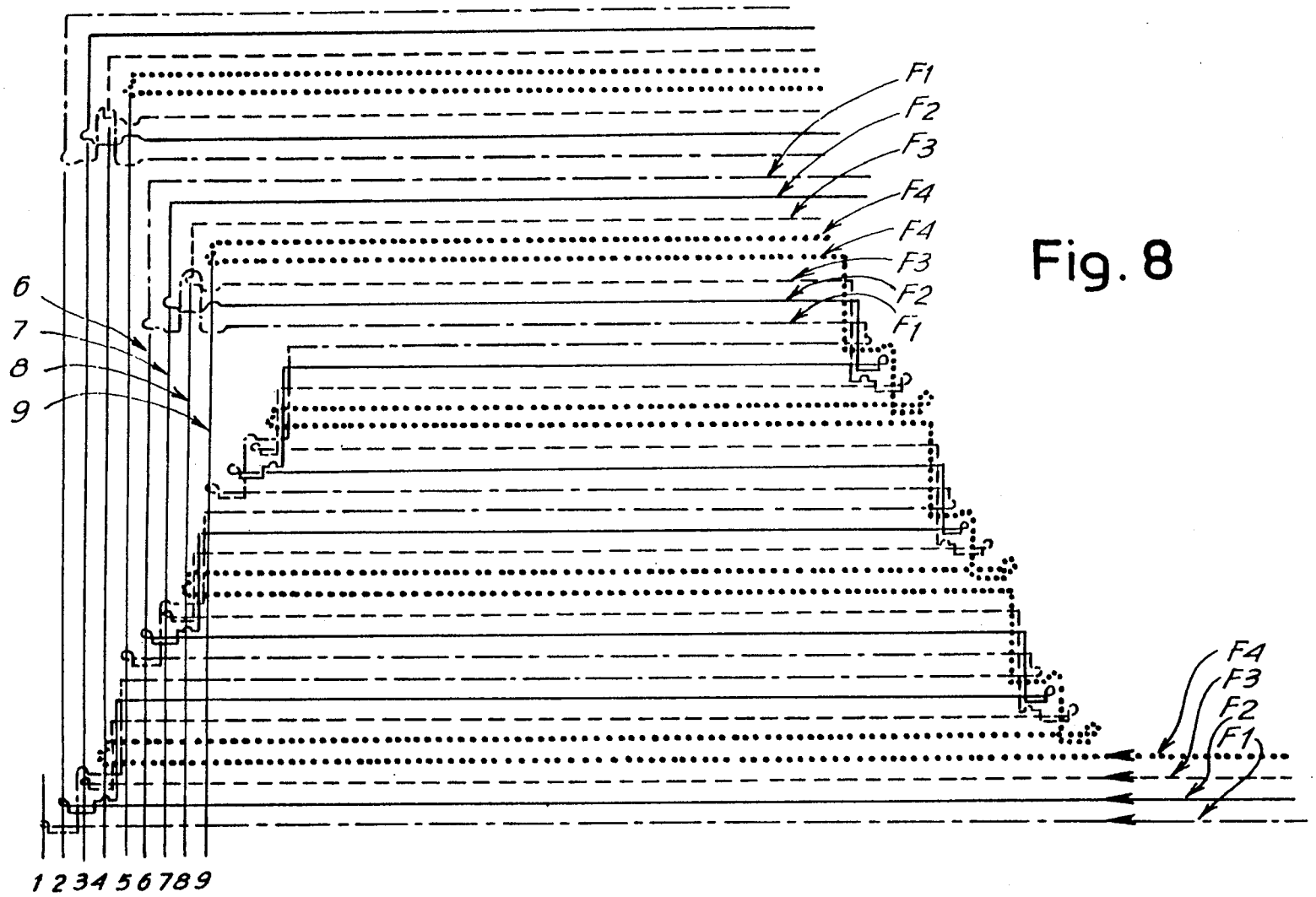

A recommended but not restrictive plan for the implementation of the invention is that in FIG. 8, in which a small arc represents a held loop (where the needle takes the yarn but does not make a stitch) and a lowered linear section represents a "float" loop, where the needle does not take yarn. According to this plan, the procedure is as follows. The last four rows F1, F2, F3, and F4 of the section 101 of the leg (see FIG. 8) each arrive at their own loop, that is to say at their own end needle 1, 2, 3, 4 of the active arc, producing regular stitches.

On reversal, the first of the rows which is carried out is F4; the needle in position 4, which is at the head of this first return row F4, will produce a held loop, while the following needles in position 5, 6 etc. will make regular stitches. In row F3, the needle 3 at the head will make a held loop, while the needle in position 4 will not take the yarn and will make a float loop and subsequently the needles in position 5 and following will make regular stitches. In row F2, the needle 2 at the head will make a held loop, the needle in position 3 will make a float loop, that in position 4 will again make a held loop, and those in position 5 and following will make a regular stitch. Considering finally row F1, the needle 1 at the head will make a held loop, the needle in position 2 will make a float loop, that in position 3 will make a held loop, that in position 4 will make a float loop, and from 5 onwards regular stitches will be made. Using the sequence indicated above, all the reversals with regard to the decreases will be brought about, and the return loops of the four rows 1 to 4 are not detached from the relevant needles and thus do not produce fabric. The above sequence is repeated—with the phase differences due to the reductions in the rows of stitches—upon each reversal of the motion.

When the increases are started, the procedure to be followed will be opposite and symmetrical to that described. Therefore, the held and float loops will be made when the reversal end is reached. As can be seen, for example, in the zone indicated by CR in FIG. 8, the last needle of F4, which is the needle in position 9, produces a held loop, in row F3, on arrival, the needle in position 9 makes a float loop and that in position 8 makes a held loop; in row F2, always on arrival, the needle in position 9 produces a held loop, that in position 8 a float loop, that in position 7 a held loop; in row F1, the needle in position 9 produces a float loop, the needle in position 8 produces a held loop, that in position 7 again a float loop and the last in position 6 a held loop. In the return phase, every needle will produce all normal loops.

It is intended that the drawing only shows an exemplary embodiment which is given only by way of practical demonstration of the invention, it being possible for this invention to vary in form and arrangement without moreover leaving the scope of the idea which forms the invention itself.

I claim:

1. A method for forming a pocket using reciprocating motion in tubular knit hosiery manufacturing using a circular knitting machine which is capable of operation by means of reciprocating motion, and is fed by means of a plurality of yarn feeds, the method comprising the steps of:

during reciprocating motion forming first part rows of stitches from the yarns of each of the various feeds on a course in one direction; forming subsequent part rows of stitches on a course in an opposite direction from yarn of each of the various feeds in a sequence opposite to said first part rows of stitches; forming subsequent part rows of stitches from subsequent courses, each course opposite the preceding course, and each course with a sequence of stitches from yarns which is opposite the preceding course to form a first part of the construction of the pocket, each successive course of said first part of the construction of the pocket forming rows which are progressively decreased in extenstion; forming a second part of the construction of the pocket including forming part rows of stitches from yarns of each of the various feeds in a sequence on a second part first course in one direction; subsequently forming part rows of stitches from yarn of each of the various feeds on a subsequent course, in a direction opposite to said second part first course, and with rows of stitches from yarns of each of the various feeds formed in a sequence opposite to said rows formed on said first course, the yarns of the various feed forming rows which progressively increase in extension in said second part; and providing points of reversal of rows forming said first part in a sequence opposite to points of reversal of rows forming said second part.

2. A method according to claim 1, wherein said sequence of said part rows of stitches are reversed in a region of said reversal points, said reversal points being arranged according to a sequence which is essentially uniform for progressively decreasing and progressively increasing, carried out on one side of the pocket wherein a similar but reversed uniform sequence for carrying out progressively decreasing and progressively increasing, is provided for an opposite side of the pocket.

3. A method according to claim 1, wherein said reversal points of rows of each yarn feed in said second part of the construction of the pocket are staggered in relation to those of said first part of the construction of the pocket.

4. A method according to claim 1, wherein rows during courses are progressively increased and progressively decreased using electronic actuators which select, needle by needle, in relation to each yarn feed.

5. A method according to claim 1, wherein four feeds are employed around a circumference of a working front of needles, wherein said reciprocating motion is developed through ranges of approximately 540°.

6. A method according to claim 1, wherein needles are operated so as to not form fabric, bringing about one of held and float loops in work zones, wherein at said work zones a reversal of direction of motion takes place.

7. A method according to claim 6, wherein on arrival to said work zones of said first part of the pocket, regular stitches are formed and on a reversal, said one of held and float loops are formed, and during the formation of said second part of the pocket, upon arrival at said work zones, said one of held and float loop are formed and, upon reversal, regular stitches are formed.

8. A method according to claim 6, wherein at an end of one of said part rows, one or more held loops are formed with subsequent rows having an alternating structure.

9. A method according to claim 6, wherein at an end of said second part of the pocket, for formation of a heel, in successive rows, every needle forms alternately held loops and float loops.

10. A tubular knitted manufactured article made using reciprocating motion of a cylinder of a circular knitting machine, and using a number of yarn feeds, comprising: a first part of the pocket formed of a first group of sets of part rows of stitches, each set of part rows of stitches of said first group progressively decreasing in extension, each set of part rows of stitches formed from a plurality of yarn feeds in a sequence with each subsequent set of part rows formed by the same feeds, but in reverse order with respect to the preceding set of part rows; a second part of the pocket formed of a second group of sets of part rows of stitches, each set of part rows of stitches of said second group progressively increasing in extension, each set of part rows of stitches formed from a plurality of yarn feeds in a sequence with each subsequent set of part rows formed by the same feeds, but in reverse order with respect to the preceding set of part rows.

11. A manufactured article according to claim 10, wherein each of said sets of part rows are connected by reversal points on each side of the pocket, said reversal points being situated according to a sequence which is uniform for said progressively decreased extension within said rows and said first part of the pocket, and wherein reversal points are situated according to a reversed sequence, providing said progressively increased extension of rows in said second part of the pocket.

12. A manufactured article according to claim 11, wherein each part row of stitches includes an end zone formed with one of held and float loops.

13. A manufactured article according to claim 12, wherein held and float loops alternate.

14. A manufactured article according to claim 12, wherein held and float loops are provided in alternate groups.

* * * * *